US006495978B2

(12) United States Patent
Yasui et al.

(10) Patent No.: US 6,495,978 B2
(45) Date of Patent: Dec. 17, 2002

(54) CRT DISPLAY DEVICE AND CUTOFF ADJUSTMENT METHOD

(75) Inventors: Hironobu Yasui, Tokyo (JP); Akinori Heishi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/909,830

(22) Filed: Jul. 23, 2001

(65) Prior Publication Data

US 2002/0047656 A1 Apr. 25, 2002

(30) Foreign Application Priority Data

Oct. 25, 2000 (JP) ..... 2000-326039

(51) Int. Cl.[7] ..... G09G 1/04

(52) U.S. Cl. ..... 315/383; 315/388; 315/30; 348/712; 348/806

(58) Field of Search ..... 315/1, 3, 30, 15, 315/16, 368.15, 368.18, 383, 387, 388; 348/355, 357, 712, 806

(56) References Cited

U.S. PATENT DOCUMENTS 4,091,419 A * 5/1978 Rhee et al. ..... 348/673
4,112,460 A * 9/1978 Arneson ..... 348/656
4,881,016 A * 11/1989 Margolis ..... 315/376
5,994,841 A * 11/1999 Allen et al. ..... 315/1
6,023,305 A * 2/2000 Ando et al. ..... 348/679
6,281,943 B1 * 8/2001 Kim ..... 348/656

* cited by examiner

*Primary Examiner*—Haissa Philogene
(74) *Attorney, Agent, or Firm*—Birch, Stewart, Kolasch & Birch, LLP

(57) ABSTRACT

A cutoff adjustment method of a CRT using a Hi-Gm tube is proposed as well as a problem that luminance of a display screen is changed by a fluctuation of a Gm voltage to be applied to a Gm electrode in relation to fluctuations of currents flowing into the Gm electrode and a G2 electrode is solved. On this occasion, the cutoff adjustment method of the Hi-Gm tube sets such that a Gm voltage value of a Gm electrode voltage source and a black level bias voltage value applied to a cathode for displaying a black level agree with each other. Further, the CRT display device having the Hi-Gm tube is constituted such that it is provided with a voltage detection circuit in an output side of the Gm electrode voltage source for measuring a fluctuation of an output voltage from the Gm electrode voltage source to keep the Gm voltage constant by a feedback from the voltage detection circuit.

9 Claims, 9 Drawing Sheets

CRT DISPLAY DEVICE AND CUTOFF ADJUSTMENT METHOD

BACKGROUND OF THE INVENTION

1. Field of the Invention

The present invention relates to CRT display devices and, more particularly, to a CRT display device having a Hi-Gm tube which is capable of obtaining an ordinary intensity of current under a low drive voltage.

2. Description of the Background Art

FIG. 6 is a block diagram showing a constitution of a conventional CRT display device. In FIG. 6, reference characters 17, 2, 3, 4, 6, 7, 9, 10, 11, 13, 18 and 19 denote a CRT, a cathode, a G1 electrode, a G2 electrode, a G3 electrode, an anode, a video cathode amplifier, a cathode bias voltage source, a video input, an adjustment input, a flyback transformer and a resistor, respectively. An electron gun which irradiates an electron beam on a phosphor screen comprises the cathode 2, the G1 electrode 3, the G2 electrode 4 and the G3 electrode 6. The cathode 2 is provided with cathodes for red, green and blue each of which emits the beam for hitting the phosphor screen of red, green and blue.

Next, FIG. 6 is explained below. The video signal input 11 is inversely amplified by a video cathode amplifier 9 and then capacitor-coupled. The thus capacitor-coupled input is applied with the cathode bias voltage in accordance with the adjustment input 13 by the cathode bias voltage source 10 and then inputted to the cathode 2. On the other hand, the anode 7 is applied with a high voltage of about 25 kV which has been boosted by the flyback transformer 18. This high voltage of the anode 7 of the CRT 17 (hereinafter referred to as CRT anode high voltage) is created by boosting and then rectifying a horizontal retrace pulse generated by a horizontal deflection output circuit. The G2 electrode 4 is applied with a voltage of about 700 V to about 1000 V generated by dividing the voltage of about 25 kV, which has been boosted by the flyback transformer 18, by the resistor 19. In the conventional CRT display device, since it is characteristic that a current does not flow in the G2 electrode 4, the resistor 19 for dividing the high voltage is about 100 MΩ.

Under a condition that the voltage to be applied to the cathode 2 (hereinafter also referred to as cathode voltage) is changed while respective voltages to be applied to the G1 electrode 3, the G2 electrode 4, the G3 electrode 6 and the anode 7 are held to be constant, when the cathode voltage becomes lower than a specified level, the electron beams emitted from the cathode 2 start flowing in a direction of a screen. The resultant flow of the electron beams from the cathode 2 in the direction of the screen is called as a beam current. The state in which the beam current is flowing shows that the beam hits the phosphor screen comprising phosphors of red, green and blue thereby allowing the screen to light. When the beam current flows in volume, the electron beam which reaches the phosphor screen is increased in number so that luminance of the screen is enhanced. In contrast, when the beam current is scarcely flowing, the luminance of the screen is decreased whereupon a video to be displayed on the screen turns to be dark. A display level of the image in which a dark screen starts lighting is called a black level. A voltage which is applied to the cathode 2 so as to display the black level is called as a black level bias voltage or a cutoff voltage.

In the conventional CRT display device, processing of adjusting the black level bias voltage called as a cutoff adjustment is performed by adjusting the cathode bias voltage to be applied to the cathode 2. A black level bias voltage value of the cathode has a variance ,for example, between 80 VDC and 110 VDC in each of the electron guns (cathodes) for R (red), G (green) and B (blue) depending on production process of the CRT. Unless such variance is corrected, a specified black color can not be displayed on the screen. The cutoff adjustment is an adjustment which allows a point in which the beam starts lighting and the black level of the video signal to agree with each other and also a processing operation which is performed for allowing the cutoff voltage of each of electron guns for R, G and B to agree with the black level of each signal so as to correctly represent a black portion and a dark portion of an image. Specifically, a coarse adjustment is first performed by adjusting a G2 electrode voltage such that a point in which the beam starts lighting to some extent is adjusted (or the G2 electrode voltage is fixed). The black level bias voltage value to be applied to each of cathodes for R, G and B is next adjusted thereby allowing the video on the screen of the CRT (hereinafter also referred to as CRT screen) and the luminance of the black color to agree with each other.

On the other hand, Japanese Patent Laid-Open No. 224618/1999 discloses a high-luminance CRT (hereinafter also referred to as Hi-Gm tube) in which a modulation electrode (hereinafter referred to as Gm electrode) is further provided between the G2 electrode and the G3 electrode. FIG. 7 is a block diagram showing a constitution of the Hi-Gm tube. In FIG. 7, reference characters 20, 21, 22, 23, 24 and 25 denotes a G1 electrode, a G2 electrode, a G3 electrode, a cathode, an electron emissive material provided on a surface of the cathode and the newly provided Gm electrode, respectively. Electrodes after the G3 electrode and the constitution as a whole are the same as those of a conventional electron gun.

FIG. 8 illustrates a potential distribution on a rotation symmetry axis in the proximity of the cathode of the Hi-Gm tube. In FIG. 8, the abscissa axis and the ordinate axis show a position (distance) (mm) from the cathode 23 and potential (V), respectively. Reference characters 26, 27 and 28 shown in FIG. 8 denote potential (electric field), a region in which the Gm electrode exists and an area in which the potential is low, respectively. Further, a dashed line shown in FIG. 8 shows potential of the cathode 23, that is, the cathode bias voltage. In the Hi-Gm tube, the Gm electrode 25 is disposed in the region shown by the reference character 27 which lies in about 0.5 mm inclusive of its vicinity far from the cathode 23. The potential 26 of the region 27 in which the Gm electrode 25 is disposed is determined by setting a direct-current voltage (DC potential) of the Gm electrode 25 at a specified voltage value, for example, 80 V. When the cathode voltage (dashed-lined portion) is changed while the Gm electrode voltage is fixed at 80 V, a quantity of the electrons which proceeds in the direction of the screen can be controlled. That is, when the potential of the cathode shown by the dashed line becomes smaller than the potential (electric field), the electrons flow whereas, when the potential of the cathode becomes larger, the electrons do not flow. It should be noted that the potential (electric field) is changed as the voltage to be applied to the Gm electrode 25 is changed.

As shown in FIG. 8, in a side of the Gm electrode 25 facing the cathode 23, electrons always exist in volume in an operating area of the cathode. Moreover, potential gradient after passing through the Gm electrode 25 is about one digit larger than that between the cathode and the G1 electrode of a conventional type. That is, the electrons which have passed in the proximity of the Gm electrode 25 do not suffer from an influence of a space charge effect whereupon many of them can proceed in the direction of the screen. Therefore, the current flowing in the direction of the screen depends on a quantity of electrons which can pass through a position where the Gm electrode 25 exists and whose potential is the lowest. By the reason described above, the same beam current as a conventional one is allowed to flow by half or less the conventional potential difference of the cathode 23. In other words, when the potential difference is the same as conventional, twice or more the conventional beam current is allowed to flow.

FIG. 9 shows a relation of each current vs cathode voltage of a Hi-Gm tube. In FIG. 9, reference characters 29, 30, 31 and 32 are a cathode current, a beam current, a G2 electrode current and a Gm electrode current, respectively. Voltage values of electrodes shown in FIG. 9 are set such that a G1 electrode voltage, a G2 electrode voltage, a Gm electrode voltage and a G3 electrode voltage are 0 V, 500 V, 80 V and 5.5 kV, respectively. As shown in FIG. 9, the more the cathode voltage is lowered, the more the beam current 30 flows thereby increasing the luminance of the screen. Further, the Gm electrode current 32 or the G2 electrode current 31 also flow in proportion to the beam current 30. Furthermore, it is also shown that, even when the beam current 30 does not flow at the time the cathode voltage is 80 V , the cathode current 29 flows into the G2 electrode. That is, it is understood that the difference between the cathode current 29 and the beam current 30 shown in FIG. 9 is equal to a sum of currents flowing in the G2 electrode and the Gm electrode.

In a case of the CRT display device using the Hi-Gm tube as described above, the Gm electrode is newly added to the conventional electron gun. In such display device using the Hi-Gm tube, it is necessary to additionally take a cutoff adjustment method using the Gm electrode potential into consideration.

Since the Hi-Gm tube allows the current twice or more as large as the conventional one to flow by the same cathode voltage amplitude as the conventional one and, moreover, sensitivity of the region in which the beam starts lighting is large, the luminance visually fluctuates to a great extent as the Gm voltage fluctuates. For example, when the potential of the Gm electrode is decreased, the point in which the beam starts lighting is decreased; that is, the black level on the screen is lowered whereupon the black color appears to be subsided. To contrast, when the potential of the Gm electrode is increased, the point in which the beam starts lighting is heighten whereupon the black color appears to be stood up like a noise.

As shown in FIG. 9, when electrons flow in the direction of the screen, that is, when the beam current flows, the current flows into the Gm electrode of the Hi-Gm tube and the beam current fluctuates in accordance with the luminance. On an occasion as described above, there exists a possibility that, when the current flowing into the Gm electrode fluctuates, a voltage source for applying a voltage to the Gm electrode allows an output voltage (Gm electrode voltage) thereof to fluctuate by being influenced by the resultant current fluctuation. There exists a problem that, when the Gm electrode voltage which the voltage source applies to the Gm electrode fluctuates, a level in which three beams start lighting relatively fluctuates whereupon a color temperature change and a luminance shift (change) may be brought about in a black color side. To solve the above-described problem, in the CRT display device using the Hi-Gm tube which is capable of allowing a large beam current to flow by a little potential difference, needed is the voltage source for keeping a supply voltage thereof to be applied to the Gm electrode to be constant, irrespective of the fluctuation of the current flowing into the Gm electrode caused by the luminance change.

Further, the current flows into the G2 electrode of the Hi-Gm tube in the same way as in the Gm electrode even when the electrons flow in the direction of the screen. Furthermore, the current value fluctuates in accordance with the luminance in the same way as in the Gm electrode. When the Hi-Gm tube is used, a current of 0.1 mA to 0.9 mA flows in the G2 electrode in a steady state whereupon, in a conventional method of dividing the voltage boosted by the flyback transformer by a resistor, a potential drop by the resistor becomes large. Moreover, an anode voltage and a focus voltage also fluctuate. When the G2 electrode voltage fluctuates, the beam current which is the current of electrons in the direction of the screen fluctuates and, accordingly, the luminance changes. Furthermore, when the G2 electrode voltage fluctuates, focus characteristics are affected to some extent. Therefore, needed is the voltage source which keeps the supply voltage thereof to be applied to the G2 electrode to be constant, irrespective of the fluctuation of the current flowing into the G2 electrode caused by the luminance change.

In the CRT display device using the Hi-Gm tube, twice or more the beam current is allowed to flow by providing a conventional cathode amplitude but, since the current flows also into the G2 electrode and the Gm electrode and, further, the current changes in accordance with the luminance, the cathode bias voltage source which is capable of allowing more than severalfold current to flow is needed. When an overcurrent which exceeds the capacity of the cathode bias voltage source flows thereinto via G2 electrode, there exists a problem that, not only output amplitude of the cathode bias voltage source is decreased, but also frequency characteristics are deteriorated thereby aggravating a video quality.

The present invention has been achieved in order to solve the above-described problems. A first object of the present invention is to provide a CRT display device which executes a cutoff adjustment in view of characteristics of a Hi-Gm tube. A second object of the present invention is to provide a CRT display device, comprising a voltage source that keeps a voltage to be applied to a Gm electrode to be constant, irrespective of a fluctuation of a current flowing into the electrode, which solves a problem that a color temperature change and a luminance change of a displayed video are brought about by a fluctuation of a Gm electrode voltage. A third object of the present invention is to provide a CRT display device, comprising a voltage source that keeps a voltage to be applied to a Gm electrode to be constant irrespective of a fluctuation of a current flowing into the electrode, which solves a problem that a luminance fluctuation is brought about by a fluctuation of a G2 electrode voltage. A fourth object of the present invention is to provide a CRT display device which solves a problem that, when an over-current flows into a cathode bias voltage source via G2 electrode, not only an output amplitude of the cathode bias voltage source is lowered, but also frequency characteristics are deteriorated thereby aggravating a video quality. Further, a fifth object of the present invention is to propose a cutoff adjustment method of a Hi-Gm tube.

SUMMARY OF THE INVENTION

A CRT display device according to the present invention comprises a CRT including an electron gun having a cathode for each of red, green and blue which emits a quantity of electrons in accordance with an applied voltage in a direction of a phosphor screen in which phosphors of red, green and blue are disposed, a G1 electrode, a G2 electrode and a G3 electrode each of which is provided in said direction of the phosphor screen from said cathode and forms an electric field by being applied with a specified voltage, and a modulation electrode which is disposed between the G2 electrode and the G3 electrode and which changes the electric field formed by each of the G1 electrode, the G2 electrode and the G3 electrode in accordance with an applied voltage, a modulation electrode voltage source which applies a voltage having a predetermined, specified voltage value to the modulation electrode, and a cathode voltage source which sets a voltage value such that it becomes the same as a modulation electrode voltage value to be applied to the modulation electrode by the modulation electrode voltage source and, further, applies a black level bias voltage value that is determined by a cutoff adjustment which finely adjusts the voltage value for the cathode for each of red, green and blue such that a black color of a displayed video when a video signal is in a black level agrees with a specified black color to the cathode when the video signal is in the black level.

A CRT display device according to the present invention comprises a CRT capable of allowing a great number of electrons to flow with a small cathode amplitude in a direction of a phosphor screen, including an electron gun having cathodes each of which emits a quantity of electrons in accordance with an applied voltage in the direction of the phosphor screen, a G1 electrode, a G2 electrode and a G3 electrode each of which is provided in the direction of the phosphor screen from the cathodes and forms an electric field by being applied with a specified voltage, and a modulation electrode which is disposed between the G2 electrode and the G3 electrode and which changes the electric field formed by each of the G1 electrode, the G2 electrode and the G3 electrode in accordance with an applied voltage, a modulation electrode voltage source which applies a voltage having a predetermined, specified voltage value to the modulation electrode, and a cathode bias voltage source which applies a voltage according to a video signal inputted from outside to the cathodes, irrespective of existence of electrons flowing into the G2 electrode and a Gm electrode among electrons which are emitted and proceed in the direction of the phosphor screen.

A CRT display device according to the present invention comprises a CRT capable of allowing a great number of electrons to flow in a direction of a phosphor screen with a small cathode amplitude, including an electron gun having cathodes each of which emits a quantity of electrons in accordance with an applied voltage in the direction of the phosphor screen, a G1 electrode, a G2 electrode, a G3 electrode and an anode electrode each of which is provided in the direction of the phosphor screen from the cathodes and forms an electric field by being applied with a specified voltage, and a modulation electrode which is disposed between the G2 electrode and the G3 electrode and changes the electric field formed by each of the G1 electrode, the G2 electrode and the G3 electrode in accordance with an applied voltage, an anode electrode voltage source for applying a specified voltage to the anode electrode, a G2 electrode voltage source which applies a voltage having a predetermined, specified voltage value to the G2 electrode, irrespective of existence of electrons flowing into the G2 electrode among electrons which are emitted from the cathodes and proceed in the direction of the phosphor screen, and a cathode bias voltage source which applies a voltage in accordance with a video signal inputted from outside to the cathodes, irrespective of existence of electrons flowing into the G2 electrode and a Gm electrode among electrons which are emitted from the cathodes and proceed in the direction of the phosphor screen.

A cutoff adjusting method according to the present invention is capable of being executed in a CRT display device including an electron gun having cathodes for red, green and blue each of which emits a quantity of electrons in accordance with an applied voltage in a direction of a phosphor screen provided with phosphors of red, green and blue, a G1 electrode, a G2 electrode and a G3 electrode each of which is provided in the direction of the phosphor screen from each of the cathodes and forms an electric field by being applied with a specified voltage, and a modulation electrode which is disposed between the G2 electrode and the G3 electrode and changes the electric field formed by each of the G1 electrode, the G2 electrode and the G3 electrode in accordance with the applied voltage, for allowing a black level of a video signal to be inputted to the cathodes for red, green and blue to agree with a black level bias voltage applied to the cathodes for red, green and blue such that electrons from the cathodes do not reach the phosphor screen, wherein the cutoff adjustment method comprises the steps of determining a modulation electrode voltage value to be applied to the modulation electrode such that it becomes a specified voltage value, setting a black level bias voltage value to be inputted to the cathodes for red, green and blue such that it becomes the same as the voltage value determined in the step of determining said modulation electrode voltage value, when the video signal of red, green and blue to be inputted to the cathodes for red, green and blue is at the black level, and finely adjusting the black level bias voltage value for each of the cathodes for red, green and blue such that a displayed image to be represented on a display screen of the CRT display device becomes a predetermined, specified black color, when the black level bias voltage is inputted to the cathodes for red, green and blue.

DETAILED DESCRIPTION OF THE PREFERRED EMBODIMENTS

First Embodiment

Figure 1:
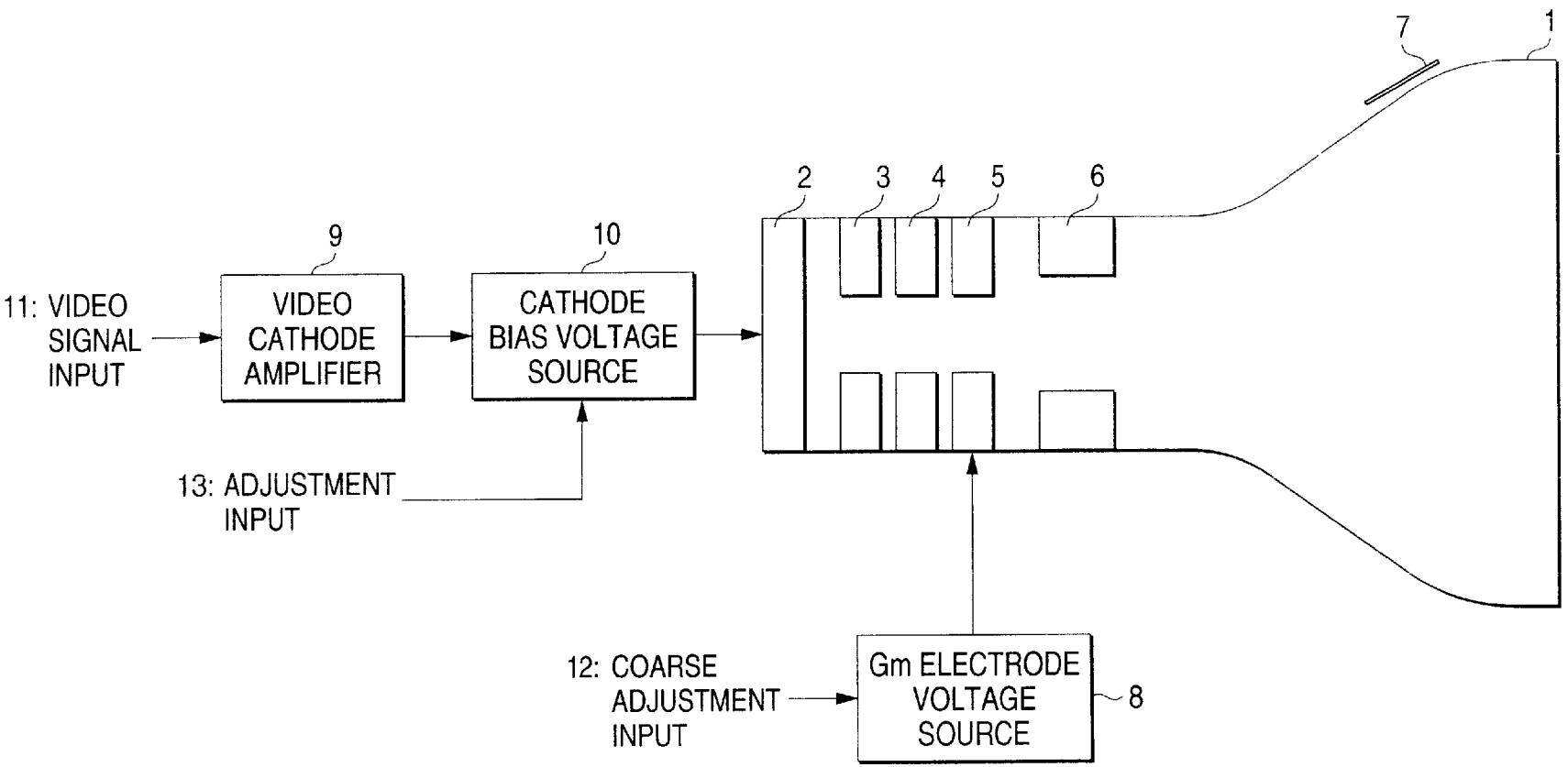
FIG. 1 is a block diagram showing a constitution of a CRT display device according to First Embodiment of the present invention.

FIG. 1 is a block diagram showing a constitution of a CRT display device using a Hi-GM tube according to a first embodiment of the present invention.

In FIG. 1, reference characters 1, 2, 3, 4, 5, 6, 7, 8, 9, 10, 11, 12, and 13 denote a Hi-Gm tube, a cathode, a G1 electrode, a G2 electrode, a Gm electrode, a G3 electrode, an anode, a Gm electrode voltage source, a video cathode amplifier, a cathode bias voltage source, a video signal input, a coarse adjustment input and an adjustment input, respectively.

Now, FIG. 1 is explained below in detail. The video signal input 11 is inversely amplified by the video cathode amplifier 9, capacitor-coupled, provided with a cathode bias voltage in accordance with the adjustment input 13 by the cathode bias voltage source 10 and then inputted to the cathode 2. A high voltage of, for example, 25 kV, which has been boosted by a flyback transformer 18 is applied to the anode 7. The resultant CRT anode high voltage is produced by using the flyback transformer 18 such that a horizontal retrace pulse generated by a horizontal deflection output circuit is boosted and subsequently rectified. Voltages of, for example, 0 V, 500 V, 5.5 kV are applied to electrodes of the G1 electrode 3, the G2 electrode 4 and the G3 electrode 6, respectively.

The Gm electrode voltage source 8 is a voltage source which applies a specified Gm voltage determined by the coarse adjustment input 12 to the Gm electrode 5. The coarse adjustment input 12 to be inputted to the Gm voltage source 18 is controlled by a volume resistor and the like. The adjustment input 13 to be inputted to the cathode bias voltage source 10 is a black-level-setting adjustment value to be controlled by the volume resistor, a DAC (DC/AC converter), a microcomputer and the like. In the Hi-Gm tube, when the cathode bias voltage is constant, potential in the proximity of the Gm electrode 5 is determined by setting the Gm electrode voltage at a specified value whereby a quantity of electrons which pass through a region in which potential in the proximity of the Gm electrode 5 is low. That is, when the cathode voltage is constant, the Gm electrode 5 can control a point which starts lightening so that a cutoff adjustment can be executed by controlling the Gm electrode voltage.

Steps of the cutoff adjustment in the CRT display device using the Hi-Gm tube are explained below in detail. As a first step, the Gm electrode voltage value to be applied to the Gm electrode 5 by the Gm electrode voltage source 8 is determined by the coarse adjustment input 12. As a second step, the black level bias voltage value to be applied to the cathode 2 when a video signal of the black level is displayed is set to be the same value as the Gm electrode voltage value which has been determined by the coarse adjustment input 12. As a third step, the black color is adjusted by means of finely adjusting a black level bias potential to be applied to each of cathodes for R, G and B colors such that the black color of the video to be displayed becomes a defined one. As a result of a fine adjustment, for example, when 81 V, 80 V and 79 V of the black level bias voltages are applied to cathodes for R, G and B, respectively, under a condition that the Gm electrode voltage is 80 V , a defined black color is displayed on a screen.

In the CRT display device having the Hi-Gm tube, it becomes possible to perform the cutoff adjustment by executing such steps as described above. Further, the black level bias potential using a conventional electron gun needs an adjustment range of several dozens of V (volts), but, in the cutoff adjustment according to the present embodiment using the Hi-Gm tube, only a few volts are distributed around the Gm electrode potential so that the amplitude of voltage to be applied can be decreased.

Figure 9:
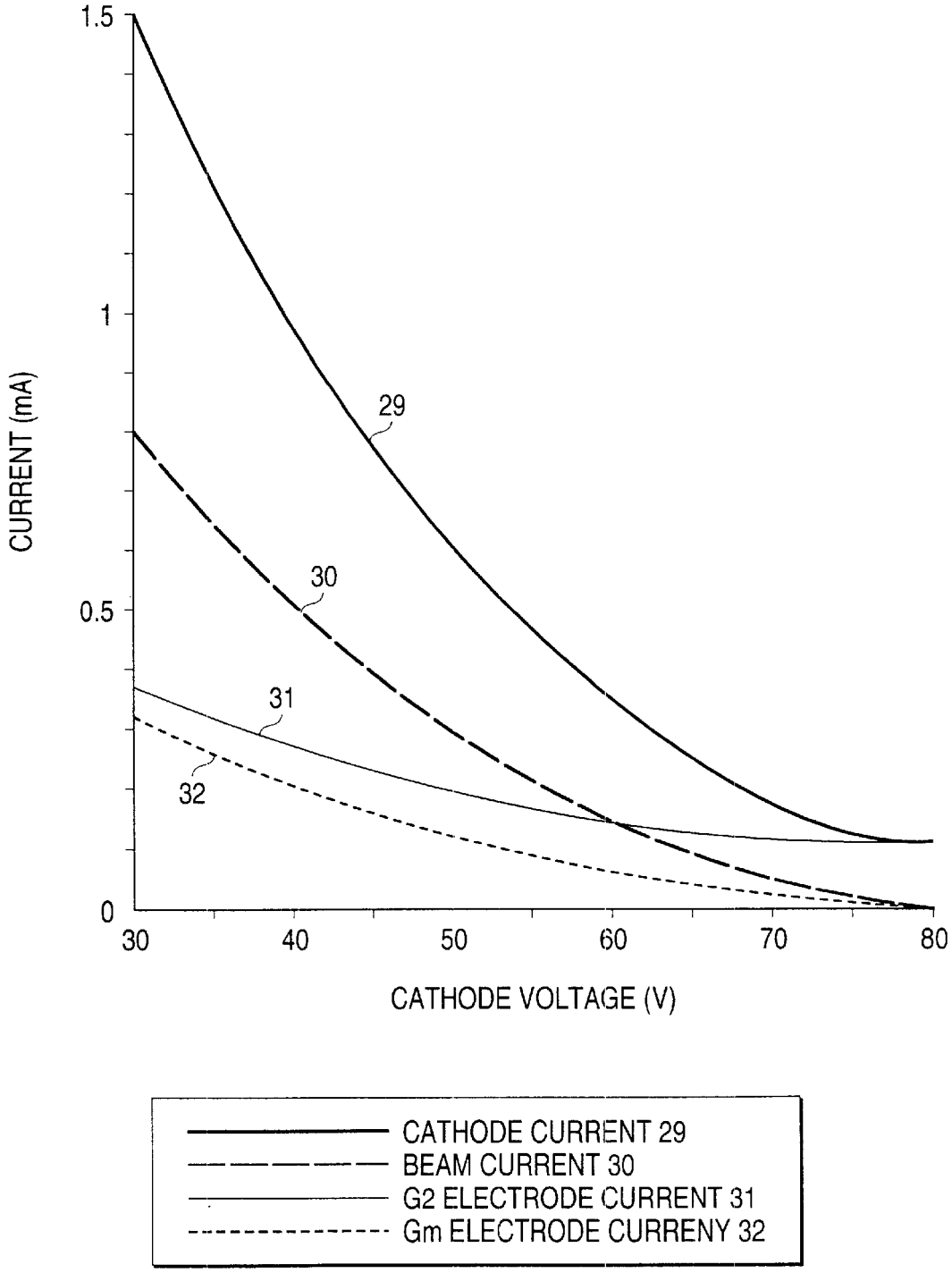
FIG. 9 illustrates each current relative to a cathode voltage of a Hi-Gm tube.

As has already been explained, in the CRT display device using the Hi-Gm tube, when the amplitude of the cathode voltage is the same as in a conventional device, twice or more times the conventional current is allowed to flow. In a conventional CRT, the cathode current and the beam current are almost same with each other, that is, the cathode current does not flow in any of electrodes. However, in the Hi-Gm tube, for example, when 0 V, 500 V, 80 V , 5.5 V and 25 kV are applied to the G1 electrode, the G2 electrode, the Gm electrode, the G3 electrode and an anode electrode, respectively, as shown in FIG. 9, the cathode current is a sum of the beam current, the G2 electrode current and Gm electrode current. That is, the current which is a difference between the cathode current and the beam current flows in the G2 electrode and the Gm electrode. Therefore, when two times the conventional beam current is allowed to flow using the Hi-Gm tube and, accordingly, the luminance is allowed to be twice, not only the cathode bias voltage source must be a type which enables twice the conventional cathode current to flow, but also the cathode current several times as much as that of the CRT display device using a conventional CRT must be allowed to flow. On the other hand, when a CRT display device having the similar luminance to that of the CRT display device using the conventional CRT is designed using the Hi-Gm tube which enables the cathode amplitude to be half, since the current flows into G2 electrode and the Gm electrode while the beam current is the same as the conventional one, the cathode bias voltage source which enables nearly twice the conventional cathode current to flow is necessary.

In the present embodiment, it is arranged that a direct current component is deleted by capacitor coupling in a post-stage subsequent to the video cathode amplifier 9 and then the cathode bias voltage and the cathode current are provided by the cathode bias voltage source 10. However, another constitution in which the bias voltage is adjusted in a pre-stage preceding to the video cathode amplifier 9 and then components including the direct current component are amplified by the video cathode amplifier 9 while the cathode bias voltage source 10 is omitted is conceivable. Also on this occasion, it is necessary that the video cathode amplifier which allows several times the conventional current to flow is necessary.

Further, in the CRT display device using the Hi-Gm tube, the Gm electrode 5 is newly provided so that the Gm electrode voltage source which provides the voltage to the Gm electrode 5 becomes necessary. As shown in FIG. 9, since electrons flow into the Gm electrode in proportion to the beam current, the Gm electrode voltage source must be constituted such that the current of 0.1 mA to 0.9 mA is allowed to flow.

Figure 2:
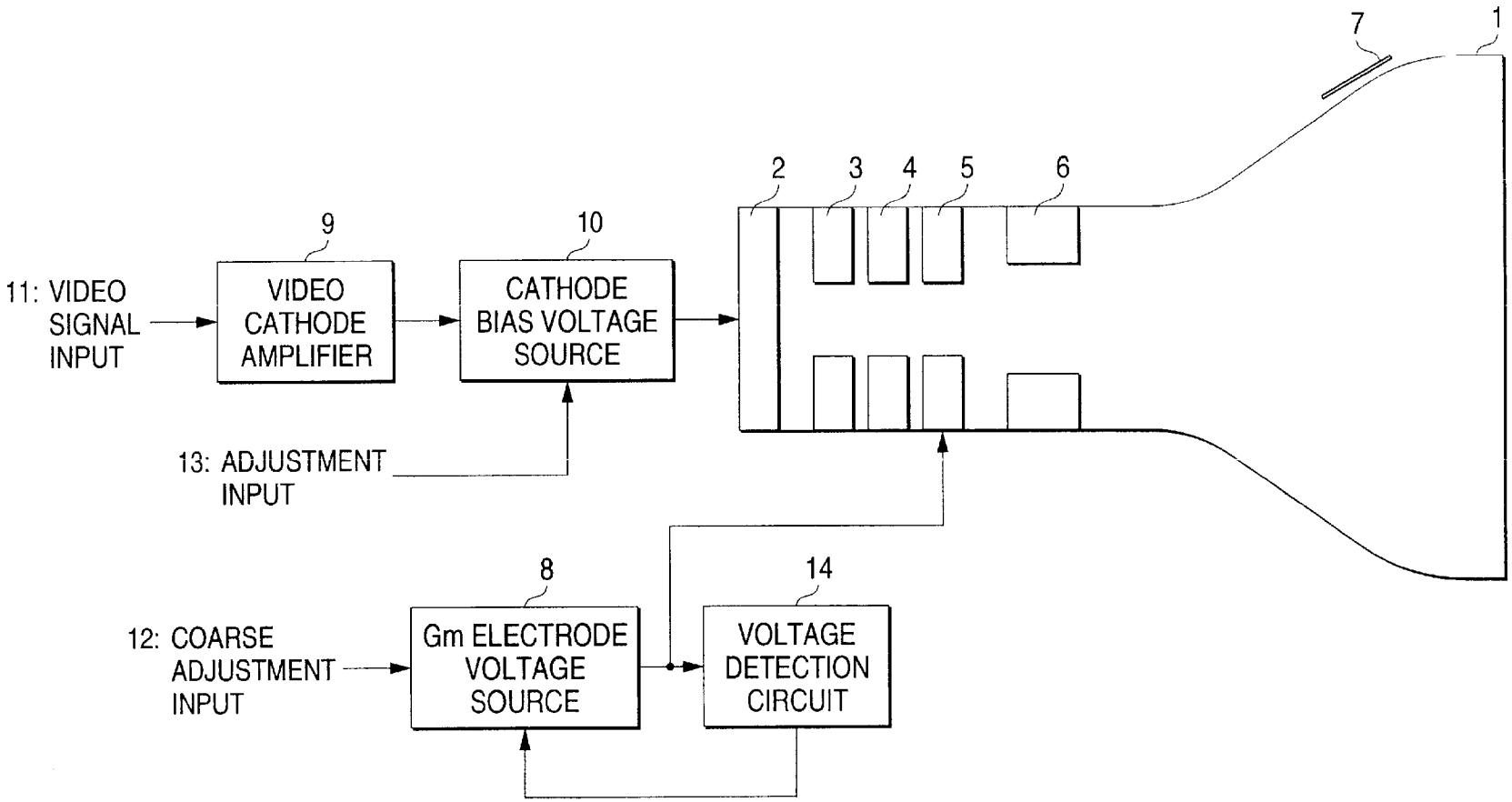
FIG. 2 is a block diagram showing a constitution of a CRT display device according to First Embodiment of the present invention.

FIG. 2 is a block diagram showing a constitutuion of a modified type of the CRT display device using the Hi-Gm tube according to the first embodiment of the present invention. Reference character 14 shown in FIG. 2 denotes a voltage detection circuit provided in an output side of the Gm electrode voltage source 8. It should be noted that same reference characters in FIGS. 1 and 2 denote identical or corresponding parts to each other so that an explanation thereof is omitted. The voltage detection circuit 14 measures a voltage fluctuation issuing from the Gm electrode voltage source 8 and feeds back a resultant measurement to the Gm electrode voltage source 8.

As shown in FIG. 9, a current flows into the Gm electrode 5 in accordance with a cathode potential. A quantity of the current is changed by a cathode voltage, that is, a video signal so that, when a quantity of a beam current is abruptly changed, for example, when a white video is displayed taking place of a black video presently in display, there exists a possibility that a voltage fluctuation is generated by a subsequent abrupt change of the quantity of the current which flows into the Gm electrode 5. In the CRT display device having the Hi-Gm tube, since sensitivity of a region in which a beam starts lighting is large owing to characteristics of a Hi-Gm electron gun, there exists a problem that, when a Gm voltage is fluctuated, a resultant fluctuation may clearly appear in the video. Further, when a Gm electrode voltage is fluctuated, a potential in the proximity of the Gm electrode is changed whereby, even when a black level cathode bias voltage which has been determined by a cutoff adjustment is applied to the cathode 2, the defined black color can not be represented on a display screen.

On this occasion, a problem that a color temperature change and a luminance fluctuation are caused by the fluctuation of the Gm electrode voltage is solved by measuring an output voltage by means of providing the voltage detection circuit 14 in the output side of the Gm electrode voltage source 8 and performing a feedback control such that the Gm electrode voltage is allowed to be a constant voltage, even if an abrupt voltage fluctuation is generated.

Second Embodiment

Figure 3:
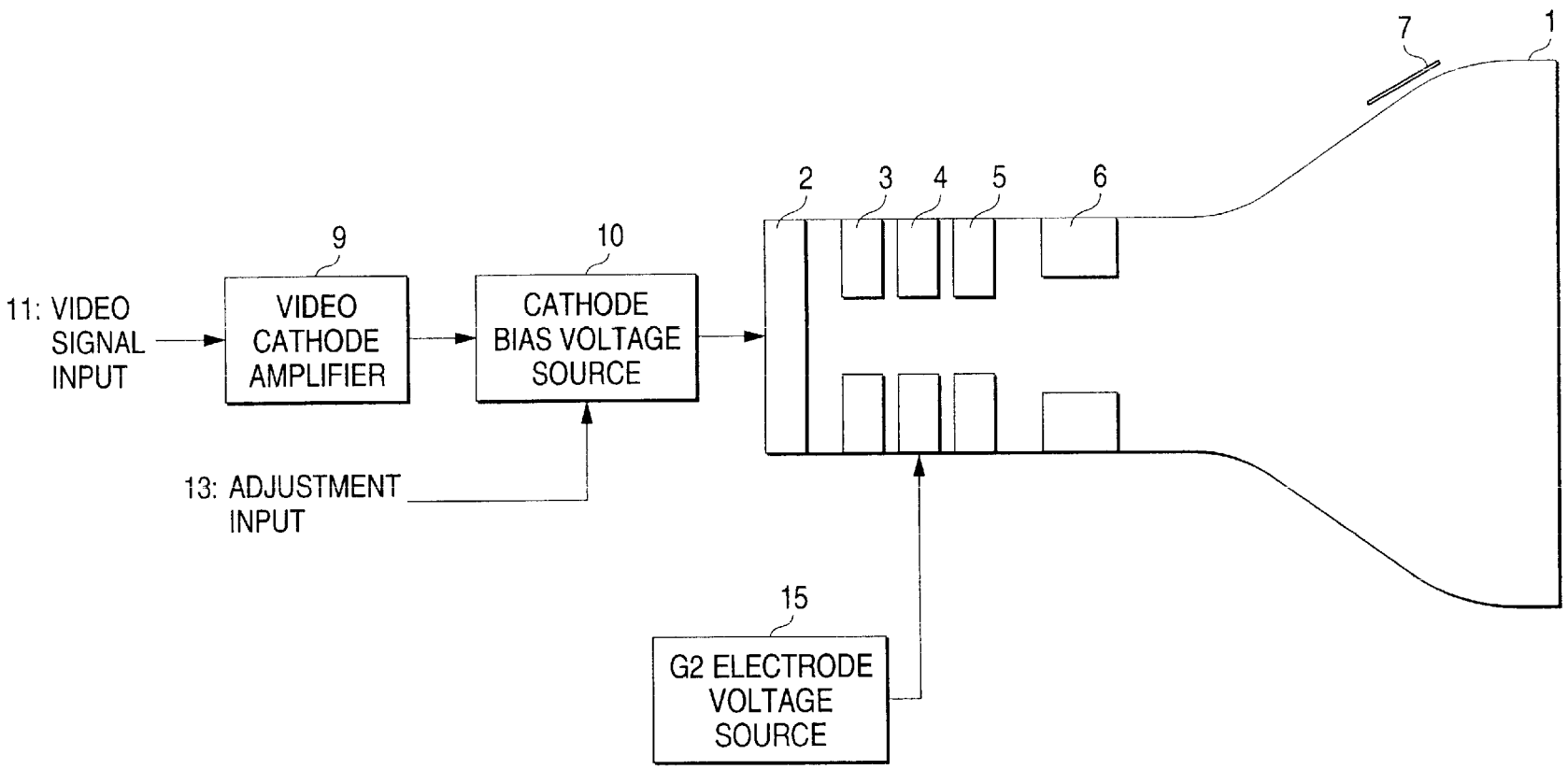
FIG. 3 is a block diagram showing a constitution of a CRT display device according to Second Embodiment of the present invention.

FIG. 3 is a block diagram showing a constitution of a CRT display device using a Hi-Gm tube according to a second embodiment of the present invention. Reference character 15 denotes a G2 electrode voltage source. Same reference characters in FIG. 3 and FIG. 1 show identical or corresponding parts to each other so that an explanation thereof is omitted.

In a conventional CRT display device, a current scarcely flows in a G2 electrode. However, in the CRT display device using the Hi-Gm tube, as shown in FIG. 9, a current of about 0.1 mA flows in the G2 electrode even when a beam current does not flow. Further, when the beam current flows, the current which flows into the G2 electrode becomes larger in proportion to the beam current. Conventionally, a voltage to be applied to an anode has been boosted by a flyback transformer, divided by a resistor and a resultant divided voltage has been applied to the G2 electrode. In such a constitution as described above, when the beam current becomes larger, that is, when luminance of a displayed video is enhanced, the G2 electrode voltage to be applied to the G2 electrode fluctuates. Furthermore, when the G2 electrode current of 0.1 mA to 0.9 mA flows, since a divided-voltage resistance value is about 100 MΩ, the voltage to be applied to an anode fluctuates. Still furthermore, a focus voltage drawn by resistor-type voltage division of an anode voltage also fluctuates to affect a focus. Moreover, when the G2 electrode voltage fluctuates, a quantity of electrons flowing in the direction of the screen fluctuates to change the luminance of the display screen. Still moreover, a fluctuation of the G2 electrode voltage affects the focus to some extent.

To cope with the above-described problem, in the CRT display device using the Hi-Gm tube, a G2 electrode voltage source should not be a conventional circuit which performs the resistor-type voltage division on the voltage boosted by the flyback transformer but should be a power supply circuit which can allow the current of 0.1 mA to 0.9 mA to flow. Therefore, the G2 electrode voltage source 15 is provided whereby it becomes possible that the voltage to be applied to the G2 electrode becomes constant by applying a specified voltage from this G2 electrode voltage source 15 to the G2 electrode irrespective of a fluctuation of the current flowing into the electrode. As a result, a problem that aluminance fluctuation of a displayed video is generated by the fluctuation of the G2 electrode voltage to affect focus characteristics can be solved. Further, by providing the G2 electrode voltage source 15 instead of the voltage source which performs resistor-type voltage division on the high voltage issued from the flyback transformer, a problem that the anode voltage is fluctuated by the fluctuation of the beam current can also be solved.

Figure 4:
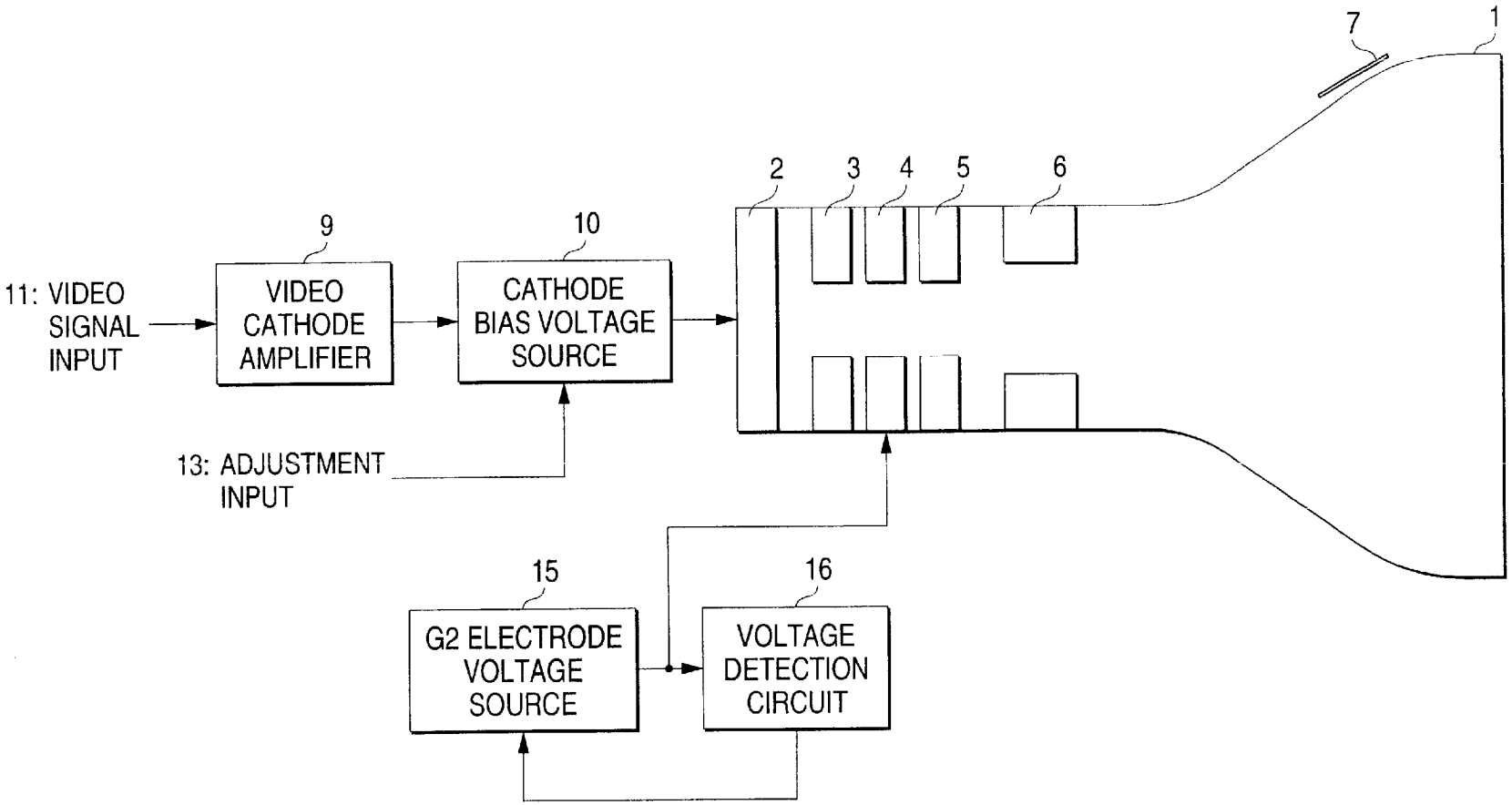
FIG. 4 is a block diagram showing a constitution of a CRT display device according to Second Embodiment of the present invention.

FIG. 4 is a block diagram showing a modified type of the CRT display device using the Hi-Gm tube according to the second embodiment of the present invention. Reference character 16 in FIG. 4 denotes a voltage detection circuit. Same reference characters in FIGS. 3 and 4 denote the identical or corresponding parts to each other so that an explanation thereof is omitted. The voltage detection circuit 16, which is provided in an output side of the voltage source 15, measures a voltage fluctuation issued from the G2 electrode voltage source 15 and then feeds back a measured result to the G2 electrode voltage source 15.

As shown in FIG. 9, a current flows into the G2 electrode 4 in accordance with a cathode potential. Since a quantity of the current changes in accordance with a cathode voltage, i.e., a video signal, when a beam current is abruptly changed such as when a white video is displayed taking place of a black video presently in display, there exists a possibility that the current flowing into the G2 electrode fluctuates and, accordingly, a voltage fluctuation is created. In a case in which the G2 voltage is fluctuated, there exists a problem that the beam current is changed and, accordingly, luminance is fluctuated. In this case, the focus characteristics are also affected.

It becomes possible by providing such voltage detection circuit 16 and controlling the G2 electrode voltage source 15 by performing a feedback that the voltage to be applied to the G2 electrode is kept to be constant, irrespective of the fluctuation of the current flowing into the G2 electrode. Therefore, a problem that a luminance fluctuation of a displayed video is generated by the fluctuation of the G2 electrode voltage can thus be solved.

Figure 5:
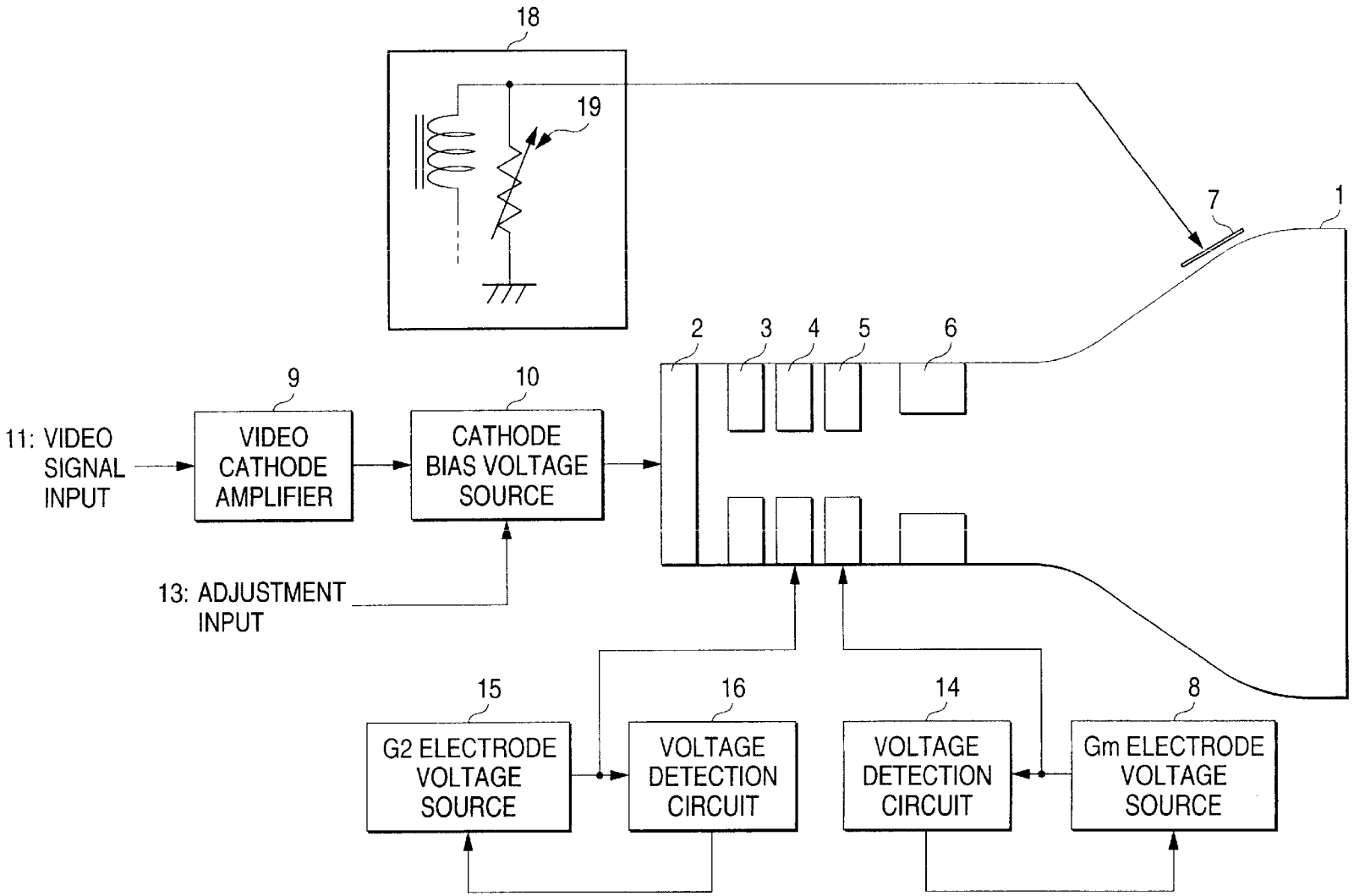
FIG. 5 is a block diagram showing a constitution of a CRT display device according to Second Embodiment of the present invention.
Figure 6:
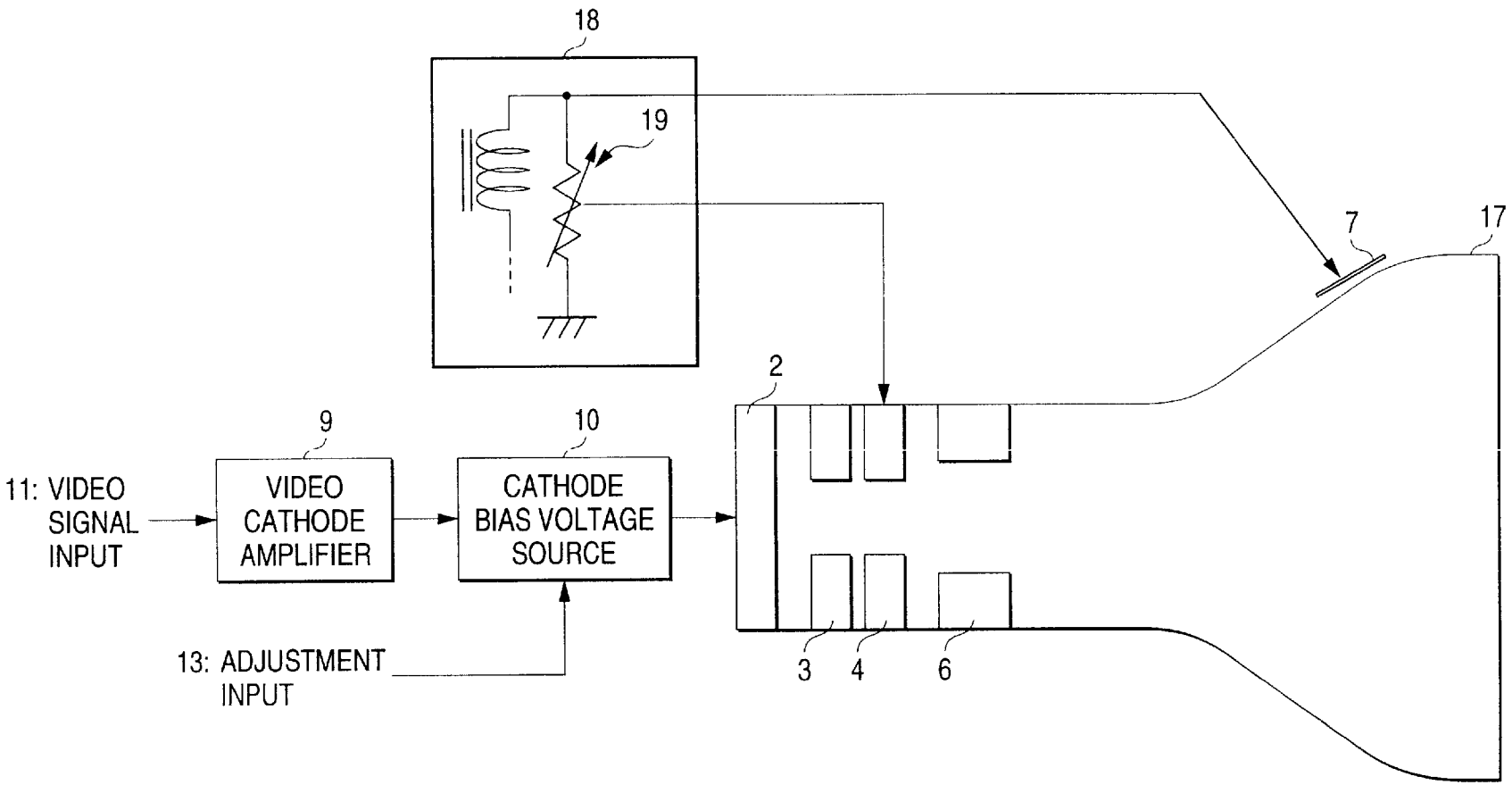
FIG. 6 is a block diagram showing a constitution of a conventional CRT.
Figure 7:
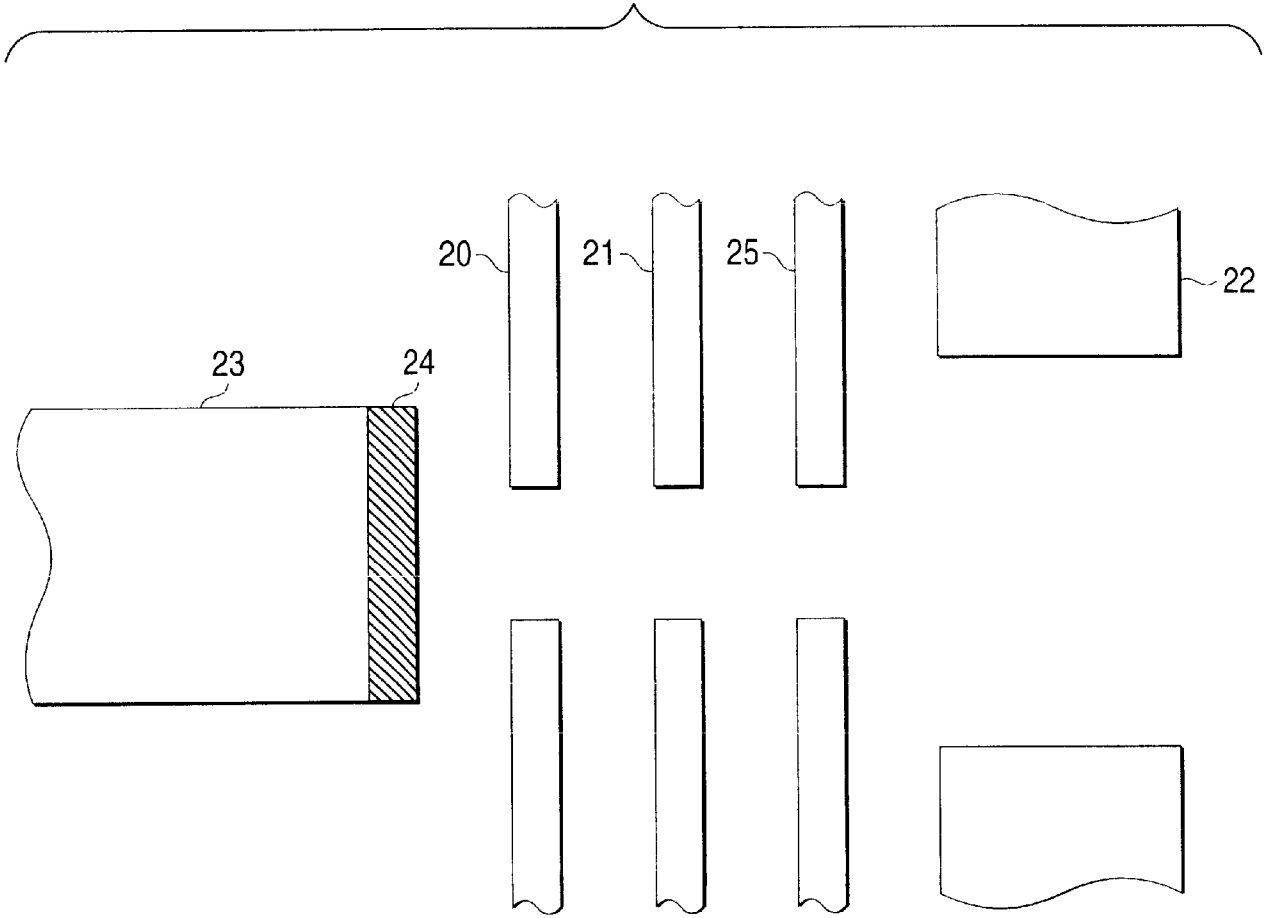
FIG. 7 is a block diagram showing a constitution of a CRT display device adopting a Hi-Gm tube.
Figure 8:
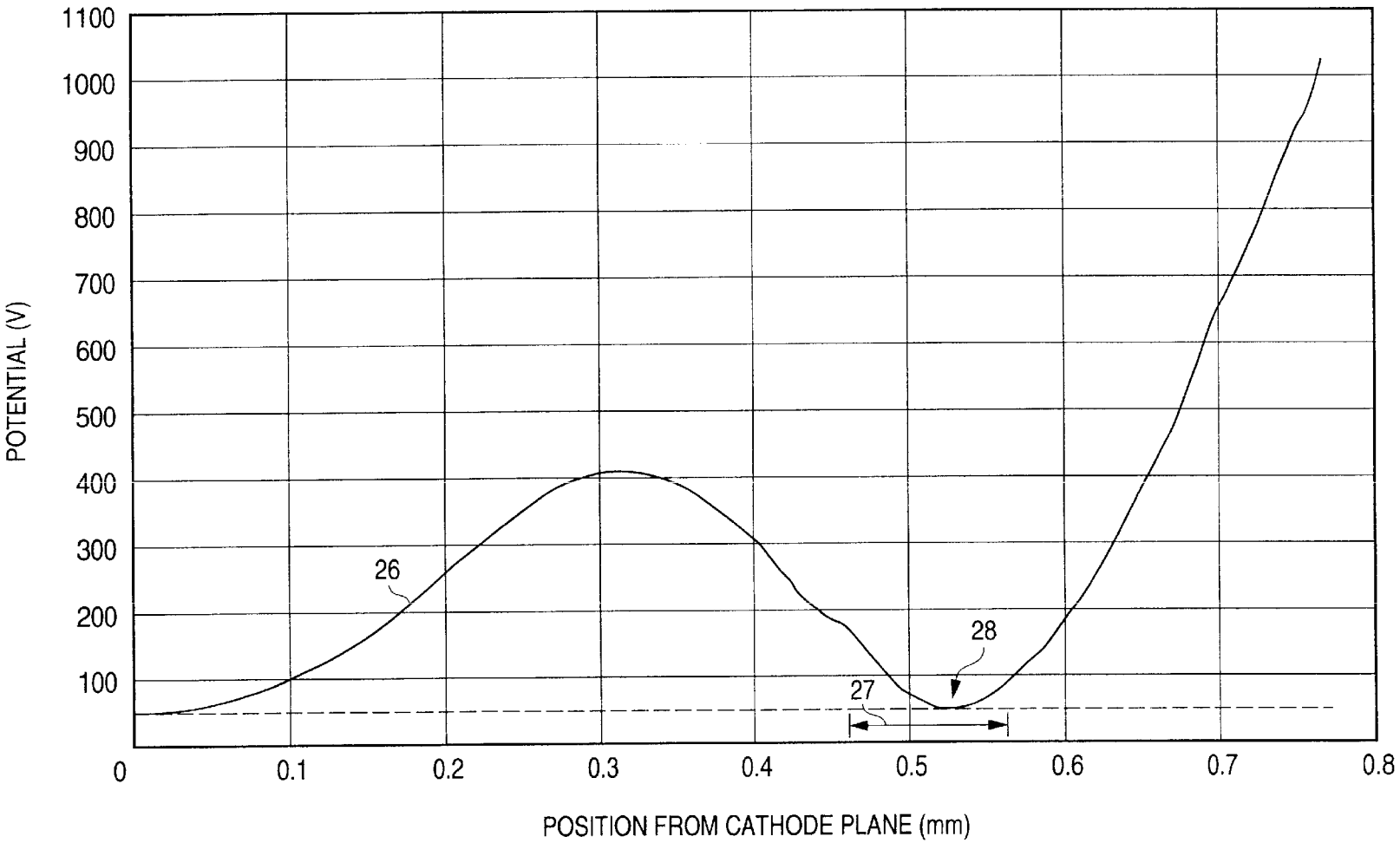
FIG. 8 illustrates a potential distribution in the proximity of a Gm electrode constituting a Hi-Gm tube.

It should be noted that the Hi-Gm tube display device shown in FIG. 4 may be provided, as shown in FIG. 5, with the Gm electrode voltage source 8 and the voltage detection circuit 14 as explained in the first embodiment.

The CRT display device shown in FIG. 5 can perform effects of the CRT display device shown in FIG. 4 by keeping the voltage to be applied to the Gm electrode 5 to be constant and, further, is capable of keeping the voltage to be applied to the Gm electrode 5 to be constant, irrespective of the fluctuation of the current flowing into the Gm electrode 5. Therefore, a problem that the color temperature change and the luminance fluctuation are caused by the fluctuation of the Gm electrode voltage can be solved.

What is claimed is:

1. A CRT display device comprising:

a CRT including an electron gun having: a cathode for each of red, green and blue which emits a quantity of electrons in accordance with an applied voltage in a direction of a phosphor screen in which phosphors of red, green and blue are disposed; a G1 electrode, a G2 electrode and a G3 electrode each of which is provided in said direction of the phosphor screen from said cathode and forms an electric field by being applied with a specified voltage; and a modulation electrode which is disposed between said G2 electrode and said G3 electrode and which changes the electric field formed by each of said G1 electrode, said G2 electrode and said G3 electrode in accordance with an applied voltage;

a modulation electrode voltage source which applies voltage having a predetermined, specified voltage value to said modulation electrode; and a cathode voltage source which sets a voltage value such that it becomes the same as a modulation electrode voltage value to be applied to said modulation electrode by said modulation electrode voltage source and, further, applies a black level bias voltage value that is determined by a cutoff adjustment which finely adjusts said voltage value for the cathode for each of red, green and blue such that a black color of a displayed video when a video signal is in a black level agrees with a specified black color to said cathode when the video signal is in the black level.

2. The CRT display device as set forth in claim 1, wherein the modulation electrode voltage source keeps the voltage to be applied to the modulation electrode to be constant based on a measured result from a voltage detection unit which detects a fluctuation of the voltage to be applied to said modulation electrode.

3. A CRT display device comprising:

a CRT capable of allowing a great number of electrons to flow with a small cathode amplitude in a direction of a phosphor screen, including an electron gun having: cathodes each of which emits a quantity of electrons in accordance with an applied voltage in said direction of the phosphor screen; a G1 electrode, a G2 electrode and a G3 electrode each of which is provided in said direction of the phosphor screen from said cathodes and forms an electric field by being applied with a specified voltage; and a modulation electrode which is disposed between said G2 electrode and said G3 electrode and which changes the electric field formed by each of said G1 electrode, said G2 electrode and said G3 electrode in accordance with an applied voltage;

a modulation electrode voltage source which applies a voltage having a predetermined, specified voltage value to said modulation electrode; and a cathode bias voltage source which applies a voltage according to a video signal inputted from outside to said cathodes, irrespective of existence of electrons flowing into said G2 electrode and a Gm electrode among electrons which are emitted and proceed in said direction of the phosphor screen.

4. The CRT display device as set forth in claim 3, wherein the modulation electrode voltage source keeps the voltage to be applied to the modulation electrode to be constant based on a measured result from a voltage detection unit which detects a fluctuation of the voltage by monitoring the voltage to be applied to said modulation electrode.

5. A CRT display device comprising:

a CRT capable of allowing a great number of electrons to flow in a direction of a phosphor screen with a small cathode amplitude, including an electron gun having: cathodes each of which emits a quantity of electrons in accordance with an applied voltage in said direction of the phosphor screen, a G1 electrode, a G2 electrode, a G3 electrode and an anode electrode each of which is provided in said direction of the phosphor screen from said cathodes and forms an electric field by being applied with a specified voltage; and a modulation electrode which is disposed between said G2 electrode and said G3 electrode and changes the electric field formed by each of said G1 electrode, said G2 electrode and said G3 electrode in accordance with an applied voltage;

an anode electrode voltage source for applying a specified voltage to said anode electrode;

a G2 electrode voltage source which applies a voltage having a predetermined, specified voltage value to said G2 electrode, irrespective of existence of electrons flowing into said G2 electrode among electrons which are emitted from said cathodes and proceed in said direction of the phosphor screen; and a cathode bias voltage source which applies a voltage in accordance with a video signal inputted from outside to said cathodes, irrespective of existence of electrons flowing into said G2 electrode and a Gm electrode among electrons which are emitted from said cathodes and proceed in said direction of the phosphor screen.

6. The CRT display device as set forth in claim 5, wherein the G2 electrode voltage source controls such that the voltage to be applied to the G2 electrode is kept to be constant based on a measured result from a voltage detection unit which detects a fluctuation of the voltage to be applied to said G2 electrode.

7. The CRT display device as set forth in claim 5, wherein the modulation electrode is applied with a voltage by a modulation electrode voltage source which applies a voltage having a predetermined, specified voltage value, irrespective of existence of electrons flowing into said modulation electrode among electrons emitted from cathodes in the direction of the phosphor screen and proceed in the direction of the phosphor screen.

8. The CRT display device as set forth in claim 7, wherein the modulation electrode voltage source controls such that the voltage to be applied to the modulation electrode is kept to be constant based on a measured result from a voltage detection unit which detects a voltage fluctuation by monitoring the voltage to be applied to said modulation electrode.

9. A cutoff adjusting method capable of being executed in a CRT display device including an electron gun having: cathodes for red, green and blue each of which emits a quantity of electrons in accordance with an applied voltage in a direction of a phosphor screen provided with phosphors of red, green and blue; a G1 electrode, a G2 electrode and a G3 electrode each of which is provided in said direction of the phosphor screen from each of said cathodes and forms an electric field by being applied with a specified voltage; and a modulation electrode which is disposed between said G2 electrode and said G3 electrode and changes the electric field formed by each of said G1 electrode, said G2 electrode and said G3 electrode in accordance with the applied voltage, for allowing a black level of a video signal to be inputted to the cathodes for red, green and blue to agree with a black level bias voltage applied to said cathodes for red, green and blue such that electrons from said cathodes do not reach the phosphor screen, the cutoff adjustment method comprising the steps of:

determining a modulation electrode voltage value to be applied to said modulation electrode such that it becomes a specified voltage value;

setting a black level bias voltage value to be inputted to said cathodes for red, green and blue such that it becomes the same as the voltage value determined in the step of determining said modulation electrode voltage value, when the video signal of red, green and blue to be inputted to said cathodes for red, green and blue is at the black level; and finely adjusting the black level bias voltage value for each of said cathodes for red, green and blue such that a displayed image to be represented on a display screen of said CRT display device becomes a predetermined, specified black color, when the black level bias voltage is inputted to said cathodes for red, green and blue.

* * * * *